United States Patent [19]

Kawabuchi et al.

[11] Patent Number: 5,041,873

[45] Date of Patent: Aug. 20, 1991

[54] COPYING APPARATUS HAVING A DETACHABLY MOUNTED STORAGE MEDIUM FOR SETTING THE OPERATION MODE OF THE APPARATUS

[75] Inventors: Yoichi Kawabuchi; Kazuhiro Araki, both of Osaka, Japan

[73] Assignee: Minolta Camera Kabushiki Kaisha, Osaka, Japan

[21] Appl. No.: 515,170

[22] Filed: Apr. 26, 1990

[30] Foreign Application Priority Data

Apr. 27, 1989 [JP] Japan ..... 1-108093
Apr. 27, 1989 [JP] Japan ..... 1-108094

[51] Int. Cl.[5] ..... G03G 21/00
[52] U.S. Cl. ..... 355/208; 355/204
[58] Field of Search ..... 355/202, 204, 133, 209, 355/313, 207, 206, 208, 205, 203

[56] References Cited

U.S. PATENT DOCUMENTS 4,243,313 1/1981 Masuda et al. ..... 355/206
4,501,485 2/1985 Tsudaka ..... 355/201
4,633,405 12/1986 Ito et al. ..... 355/314
4,699,501 10/1987 Watanabe et al. ..... 355/204 X
4,711,560 12/1987 Hosaka et al. ..... 355/200
4,764,789 8/1988 Iwaki et al. ..... 355/209
4,780,806 10/1988 Wada et al. ..... 355/200
4,806,978 2/1989 Nakatani et al. ..... 355/202
4,821,107 4/1989 Naito et al. ..... 355/202
4,847,656 7/1989 Kuno et al. ..... 355/202
4,944,031 7/1990 Yoshino et al. ..... 355/206

FOREIGN PATENT DOCUMENTS 0019367 1/1989 Japan ..... 355/204

OTHER PUBLICATIONS

U.S.S.N. 06/780,612 filed Nov. 26, 1985, entitled Control Device for an Apparatus.
U.S.S.N. 07/426,092 filed Oct. 24, 1989, entitled Image Duplicating Apparatus.

*Primary Examiner*—A. T. Grimley
*Assistant Examiner*—William J. Royer
*Attorney, Agent, or Firm*—Willian Brinks Olds Hofer Gilson & Lione

[57] ABSTRACT

A copying apparatus in which an operation mode defined by items such as the number of copies and copying magnification registered on an IC card can be changed by loading the IC card in the copying apparatus. A device in the apparatus prohibits change of the operation mode until the termination of a copying operation, when the IC card is inserted during the copying operation. Since the operation mode registered on the IC card is attached to the copying apparatus after the termination of the copying operation, no copying is performed in a mode that an operator does not desire.

19 Claims, 11 Drawing Sheets

COPYING APPARATUS HAVING A DETACHABLY MOUNTED STORAGE MEDIUM FOR SETTING THE OPERATION MODE OF THE APPARATUS

BACKGROUND OF THE INVENTION

1. Field of the Invention

The present invention relates generally to copying apparatuses, and more particularly, to a copying apparatus to which data in storage medium (for example, IC card) can be loaded to set operation modes defined by the data.

2. Description of the Related Art

Proposed is a system wherein an operation mode (mode which define an operation manner of the copying apparatus, such as copying magnification, exposure amount, size of copy paper, the number of copies or the like) of a copying apparatus is registered in a storage medium such as an IC card and the operation mode is set in a lump in the copying apparatus by attaching the storage medium to the copying apparatus.

In the above described system, when the IC card is detached from the copying apparatus to release connection of the card with the apparatus, a prescribed operation mode (an operation mode before insertion of the card, a standard operation mode or the like}is set which is predetermined as a basic mode to which the copying apparatus is to be restored.

In the above described system, attaching or detaching of the IC card during the copying operation causes such problems as show in the following.

In the following description, for convenience, an operation mode registered on the IC card is referred to as "mode A", and an operation mode predetermined as a basic operation mode to which the apparatus is to to restored (operation mode set before the insertion of the IC card or a standard operation mode) is referred to as "mode B".

(1) Detaching of the card during the copying operation

In the above described system, when the IC card is detached from the copying apparatus during the copying operation in the "mode A", the "mode B" is immediately set. Therefore, the copying operation mode which is being executed is changed during copying operation, resulting in causing miscopying. In order to prevent it, proposed is a system which prohibits mode change during the copying operation in the above described system.

However, in the above described system, when the IC card is detached during the copying operation, the "mode A" is maintained also after the end of copying operation.

The IC card is detached when the operation mode of the copying apparatus is to be restored to the "mode B".

Accordingly, the operator who has detached the IC card is liable to expect that the "mode B" is set after the end of the copying operation.

Therefore, the mode as the operator desires (in this case, "mode B") and the mode set in the copying apparatus after the end of the copying operation (in this case, "mode A") differ from each other, which might cause miscopying.

(2) Insertion during the copying operation

Similar problem occurs in loading the data of the card by attaching the IC card in the copying apparatus.

Namely, in this case, even though the IC card is attached to set the "mode A" in the copying apparatus, the "mode B" is set after the termination of the copying operation.

(3) Furthermore, such problems as shown in the following occur if a system is adopted for the copying apparatus wherein the mode is set by the IC card, and the operation mode set at the time of the trouble is saved in a predetermined memory when such trouble as a paper jam occurs and the saved operation mode is reset in the copying apparatus after recovering from the trouble.

(i) If such trouble as a paper jam occurs when the copying apparatus is operated in the operation mode (mode A), the "mode A" is saved in a predetermined memory.

In such a state, when the IC card is detached from the copying apparatus, the "mode B" is set in the copying apparatus. Generally, the IC card is detached when it is required to be restored to the above described "mode B".

Then, after it is recovered from the trouble by a predetermined processing, the saved "mode A" is reset to the copying apparatus.

Namely, the mode as the operator desires (in this case, "mode B") and the mode to be set after the recovery from the trouble (in this case, "mode A") differ from each other to cause miscopying.

(ii) The same problem arises also when IC card is attached to the copying apparatus to load the data of the card at the time of trouble such as a paper jam or the like.

More specifically, in this case, even though the IC card is attached in order to set the "mode A" to the copying apparatus, the "mode B" is actually set after the recovery from the trouble.

SUMMARY OF THE INVENTION

Therefore, an object of the present invention is to reduce miscopying in a copying apparatus wherein data is set by using storage medium.

A further object of the present invention is to make copying as an operator desires when storage medium is set or detached from a copying apparatus wherein data is set by using the storage medium.

Another object of the present invention is to automatically store an operation mode when trouble arises and automatically restore the mode after the recovery from the trouble and also to reduce miscopying in a copying apparatus wherein data is set by using storage medium.

The above described object of the present invention can be achieved by a copying apparatus including the following elements. Namely, the copying apparatus according to the present invention comprises a main body having an image forming device operable in various modes, storage medium which can be attachable to and detachable from the main body for storing information for setting an operation mode of the image forming device, first control device for reading the information stored in the storage medium when the storage medium is attached to the main body when the image forming device is not operating, and setting the operation mode of the image forming device based on the read out information, and a second control device for setting the operation mode of the image forming device by the information stored in the storage medium after the termination of the operation of the image forming device, when the storage medium is attached to the main body during the operation of the image forming device.

Since the copying apparatus comprises the above described elements, if the storage medium is attached during the operation of the copying apparatus, the operation mode registered in the storage medium is set after the end of the copying operation.

Therefore, after the end of the copying operation, the operation mode as the operator desires is set, which prevents miscopying. As a result, miscopying is reduced in the copying apparatus which data is set by using the storage medium.

According to another aspect of the present invention, the copying apparatus comprises a main body having an image forming device operable in various modes, a trouble detecting device for stopping an operation of the image forming device when trouble of the image forming device occurs, storage medium which can be attachable to and detachable from the main body and stores information for setting an operation mode of the image forming device, a first control device for reading the information stored in the storage medium attached to the main body stores and for setting the operation mode of the image forming device, based on the read out information, a second control device for automatically setting the operation mode before the trouble, after the termination of processing for the trouble, and a third control device for prohibiting an operation of the second control, device to set an operation mode of the image forming device by the information stored in the storage medium after the termination of the processing for the trouble, when the storage medium is attached to the main body at the time of the trouble.

Since the copying apparatus comprises the above described elements, if the storage medium is attached at the time of the trouble of the copying apparatus, the operation mode registered in the storage medium is set after the end of the processing for the trouble.

Accordingly, after recovery from the trouble, a mode as the operator desires is set to the copying apparatus, thereby preventing miscopying. As a result, when trouble arises, an operation mode is automatically stored and restored after recovering from the trouble, and in addition, in the copying apparatus wherein data is set by using storage medium, miscopying can be reduced.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiment of the present invention will be described in the following.

Description of Mechanism

Figure 1:
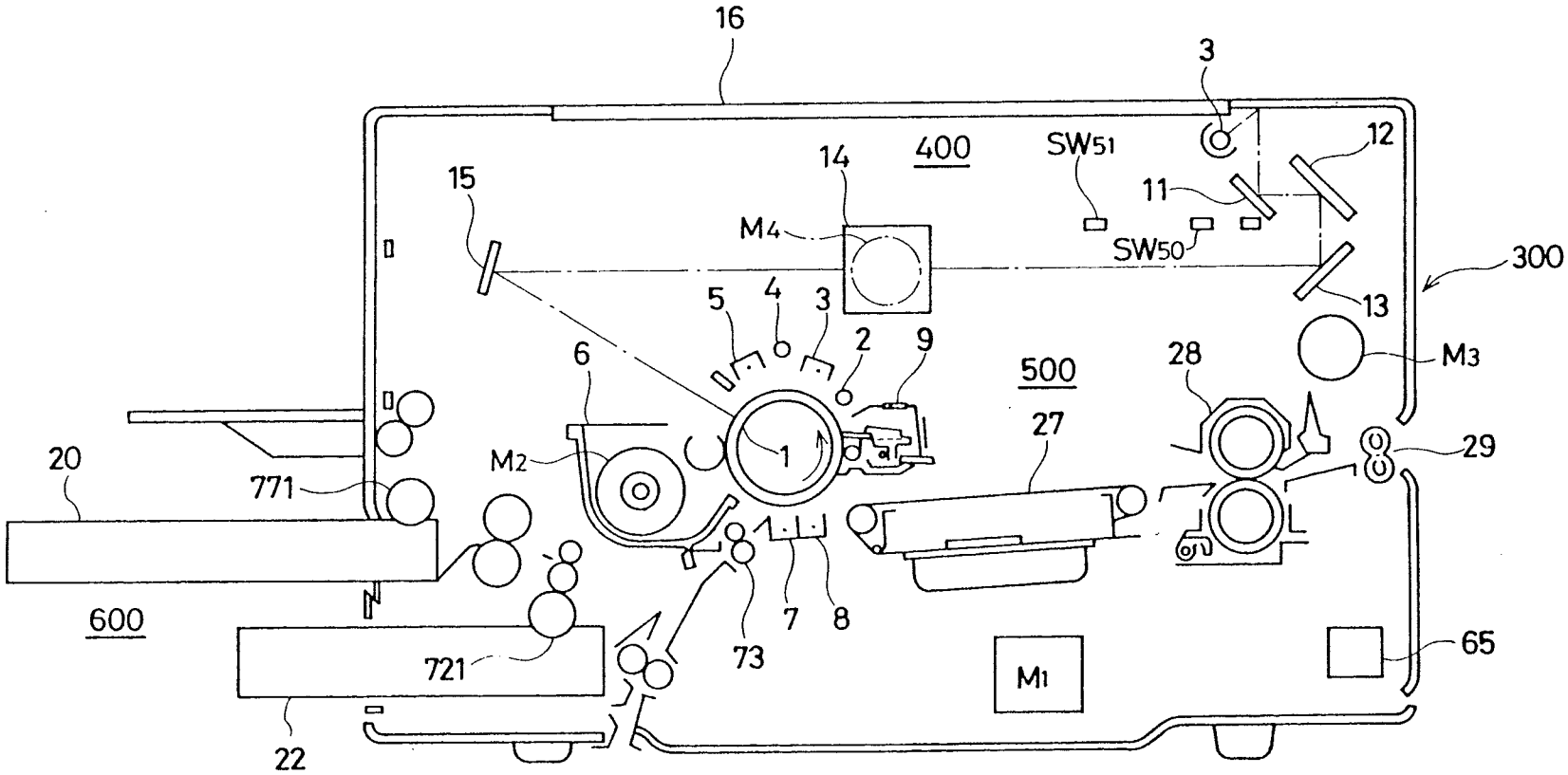
FIG. 1 is a schematic diagram of a structure of a copying apparatus according to the present invention.

Referring to FIG. 1, a schematic structure of a copying apparatus according to the present invention will be described.

The illustrated copying apparatus comprises an optical system 400 provided in an upper portion and an image forming portion 500 provided in a lower portion of a body 300, and a paper feed cassette 600 provided on the left side of the main body 300 in the drawing.

(i) Optical system 400

The optical system 400 scans an original set on a platen glass 16 by exposure to form an image reflected from a surface of the original, on a surface of a photoreceptor drum 1 of the image forming portion 500.

The optical system 400 comprises a fluorescent exposure lamp 3, reflecting mirrors 11, 12, 13 and 15, and a lens 14. The fluorescent exposure lamp 3 and the reflecting mirror 11 are driven by a motor M3 at a speed of V/N (V; a circumference speed of the photoreceptor drum 1, N; copying magnification) and, the reflecting mirrors 12 and 13 at a speed of V/2N, respectively, to reciprocate along a lower surface of the platen glass 16, thereby scanning the original by exposure.

By adjusting location of the lens 14 and the reflecting mirror 15, the copying magnification is set and by adjusting the angle of the reflecting mirror 15, location of the image is rectified. These are driven by a motor M4. In order to detect location of a moving portion of the optical system, sensors SW50 and SW51 are provided.

(ii) Image forming portion 500

The image forming portion 500 performs image forming by a so-called electrophotographic process. An electrostatic latent image formed on the photoreceptor drum 1 is developed by using toner, and the image is transferred onto a copy paper, fixed thereon and then the paper is discharged.

The image forming portion 500 comprises a photoreceptor drum 1 rotatably supported in a counter clockwise direction, eraser lamps 2 and 4 disposed around the photoreceptor drum 1, sensitizing chargers 3 and 5, a developing device 6 (driven by the motor M2), a transfer charger 7, a separation charger 8, a cleaning device 9, a transport belt 27 for transporting copying paper which is already transferred, a fixing device 28 for fixing toner image on the transported paper, and a roller pair 29 for discharging the copy paper with the image fixed thereon from the image forming portion 500.

Provided below the photoreceptor 1 is a timing roller pair 73 for sending fed copy papers between the photoreceptor drum and the transfer charger at a predetermined timing in synchronization with the rotation of the photoreceptor drum 1 and also provided below the transport belt 27 is a main motor M1. A reset switch 65 for trouble is provided rightward to the main motor M1.

The paper feed cassette 600 comprises an upper paper feed tray 20 and a lower paper feed tray 22 for storing various sizes of paper. After discharged by paper feed rollers 771 and 721, the paper in each tray is fed to the timing roller pair 73 in the image forming portion 500 and sent between the photoreceptor drum 1 and the transfer charger 7, in synchronization with the rotation of the photoreceptor drum 1, in response to a predetermined timing signal from the optical system 400, and then subjected to the image forming process.

Description of the operation panel

Figure 2A:
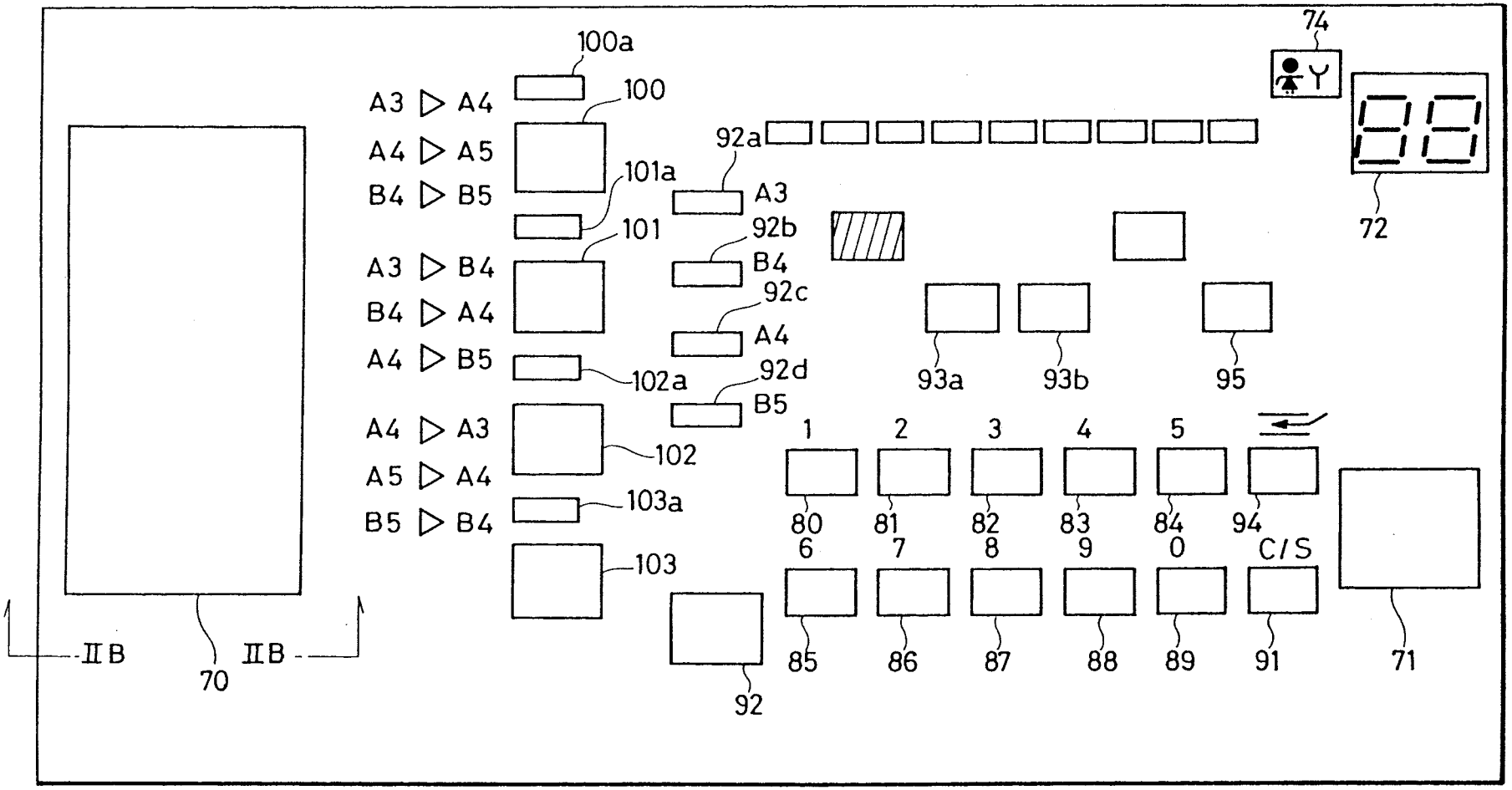
FIGS. 2A and 2B are diagrams explaining an operation panel of the copying apparatus.

Referring to FIG. 2A, an operation panel of a copying apparatus according to the above described embodiment will be described.

Figure 2B:
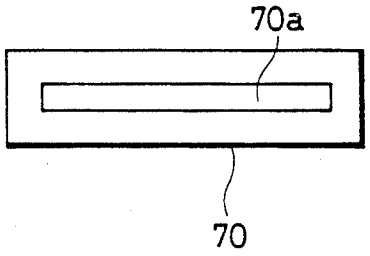

As shown in the drawing, provided on the operation panel are an IC card insertion portion 70, a two-digit numeric value displaying portion 72 for segment displaying the number of copy, an all clear key 95 for instructing restoration of an operation mode to an "initial mode", a trouble indicating portion LED 74 for indicating the occurrence of such trouble as a paper jam by means of light, a print key 71 for instructing a start of a copying operation, ten key groups 80-89 for inputting numeric value data such as the number of copy, and density setting keys 93*a* and 93*b* for setting copy density. Further provided on the operation panel are a copy paper selecting key 92 for sequentially selecting copy paper on a size basis, a size of copy paper displaying LEDs 92*a*-92*d* displaying a selected size of the copy paper, magnification keys 100-103 for selecting a copying magnification, magnification displaying LEDs 100*a*-103*a* for displaying a selected copying magnification, an interruption key 94 for instructing setting of an interruption copy mode, and a clear/stop key 91. FIG. 2B is a diagram showing a view taken on the lines IIB-IIB, which shows an insertion inlet 70*a* of the IC card insertion portion.

Description of control circuit

Figure 3:
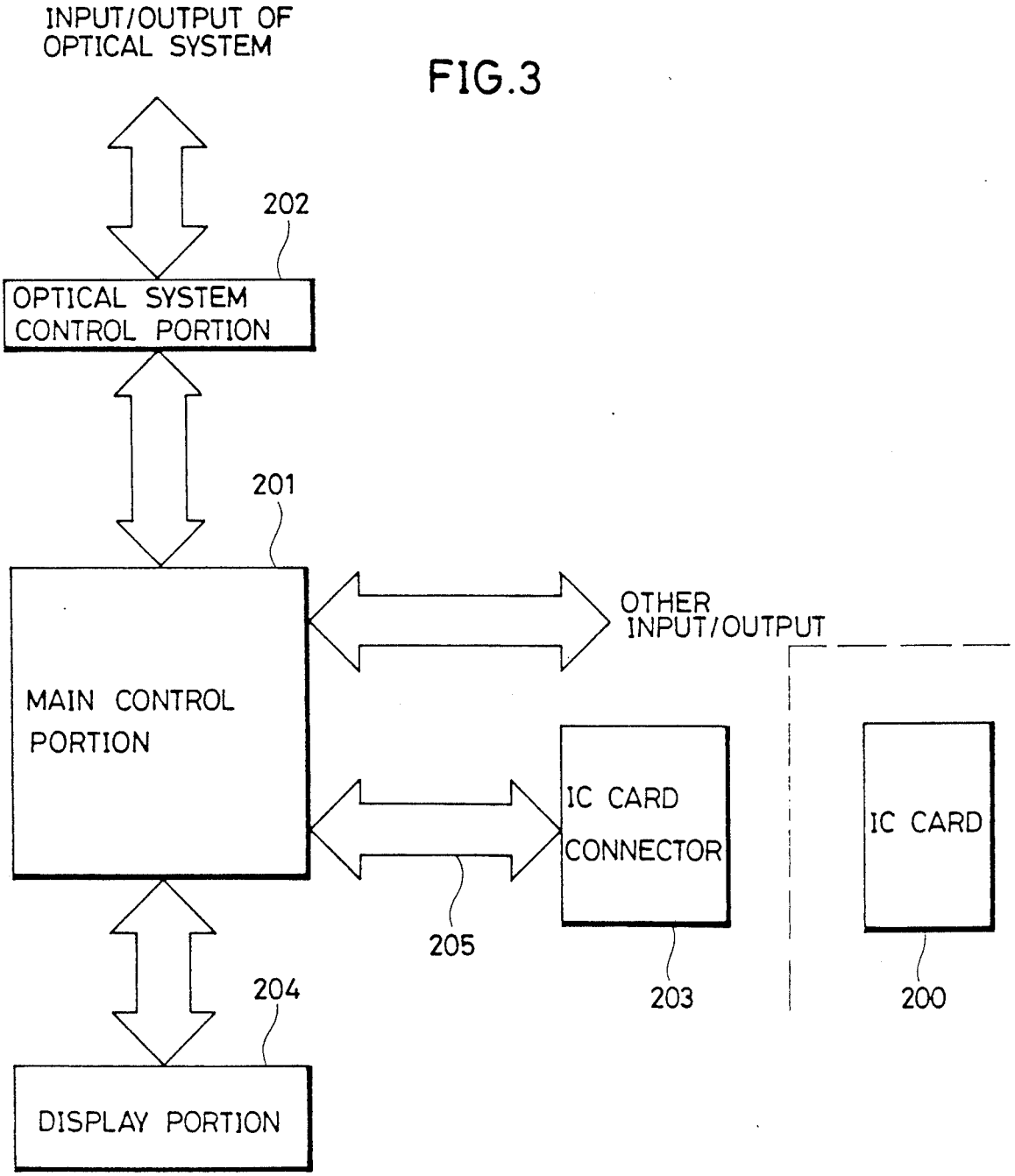
FIG. 3 is a block diagram of a control circuit of the copying apparatus.

FIG. 3 is a circuit diagram showing a structure of the control device of the above described copying apparatus and the IC card.

As shown in the drawing, the control portion comprises a main control portion 201 for controlling an operation of the body of the copying apparatus, and an optical system control portion 202 connected to the main control potion 201 through a bus for controlling an operation of the optical system while communicating with the control portion.

The main control portion 201 receives signals from various operation switches such as the main switch, the print switch, the ten key, the exposure key and the like (see an operation panel in FIG. 2A), from various sensors provided in respective positions in the copying apparatus for detecting an operation state and the like, and from other not-shown control CPU and the like. The main control portion 201 outputs signals for controlling drive of various devices provided around the photoreceptor drum 1, signals for controlling drive of the main motor, various clutches in the paper feed system and the like (see schematic structure of the copying apparatus of FIG. 1), and signals to other not-shown control CPU and the like. The above described input-/output signals are shown in FIG. 3 as "other inputs-/outputs".

The main control portion 201 is connected to an IC card connector 203 through a data bus 205 and sends and receives data to and from the IC card 200 when it is connected by attaching the IC card 200 in the card insertion portion 70.

The main control portion 201 is further connected to a driving circuit of a displaying portion 204 to make various displays corresponding to an operation state of the copying apparatus and the like. The displaying portion 204 comprises, for example, the trouble indicating portion 73, the two-digit numeric value displaying portion 72 and the like.

The optical system control portion 202 is connected to a driving circuit of an optical system driving motor, various sensors, a driving circuit of an exposure lamp and the like to control an operation of the optical system while communicating with the main control portion 201.

Description of the Operation (A) Outline of the Description

Figure 4:
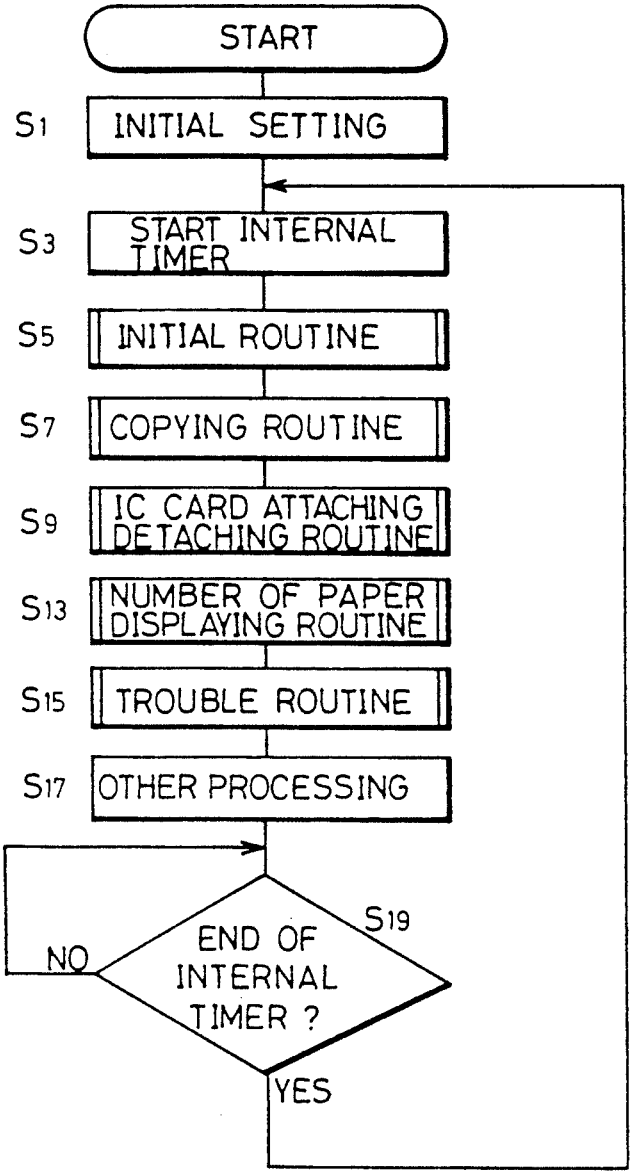
FIG. 4 is a flow chart showing a main routine for a processing in a CPU constituting a main control portion of a copying apparatus.

FIG. 4 is a flow chart showing the main routine of the processing in the control CPU constituting the main control portion 201.

The control CPU starts its processing as, for example, the main switch is turned on to firstly set an initial state (S1).

In this case, the initial state is a state which is supposed to be most frequently used by a general user and in the present embodiment, it is the state (basic initial state) shown in the step S111 (will be described later).

Then, an internal timer for defining a time period for one routine is set (S3) and each processing of S5-S11 is performed, and thereafter the program returns to the step S3 when the internal timer set in S3 ends at S19 thereby to repeat the processing.

(1) Initial routine

The initial routine will be described with reference to FIG. 5.

An operation mode of the copying apparatus is restored to the "a predetermined initial state" when the condition of the predetermined initialization such as an input of the all clear key 95 and the like is fulfilled. "A predetermined initial state" to be restored varies depending on whether the IC card 201 is attached or not or the like.

The details of the processing will be described later.

(2) Routine of Copying Operation

It is the processing for controlling the copying operation. In this step, the auto clear timer concerning the condition of the above described initialization is set.

The details of the processing will be described later.

(3) IC card Detaching Routine

A change of the operation modes relating to attaching and detaching of the IC card and the like is controlled.

The details of the processing will be described later.

(5) The number of papers indicating routine

Indication of the number of papers to be copied is controlled.

(6) Trouble routine

Processing in case of a paper jam in the copying apparatus is performed.

The details of the processing will be described later.

(7) Other processings

The key input processing, temperature control, communication with other CPUs and the like are controlled. Contents thereof are well know and therefore no detailed description will be made.

(B) Description of each sub-routine (1) Initial routine

Figure 5:
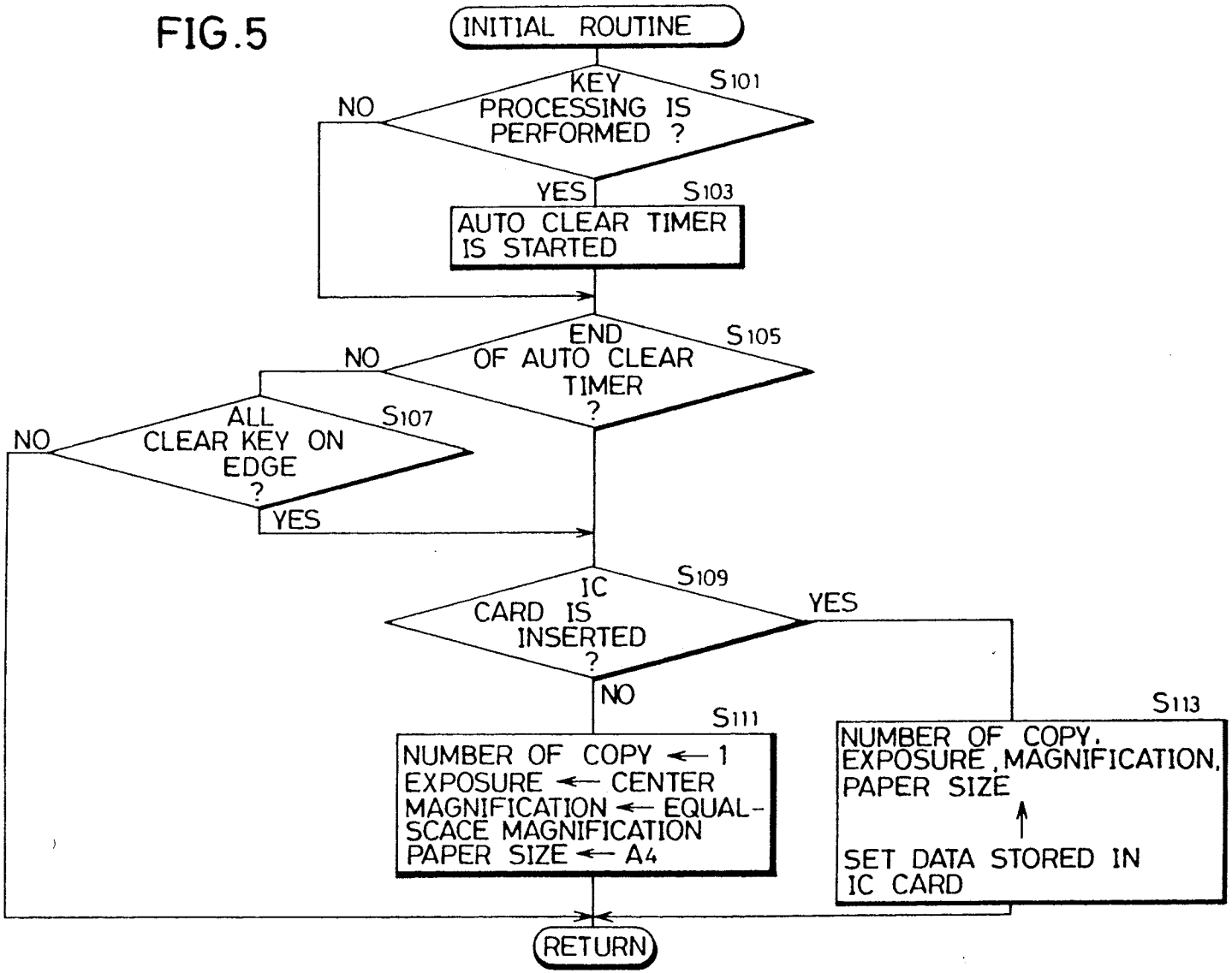
FIG. 5 is a flow chart showing in detail an initial routine shown in FIG. 4.

Referring to FIG. 5, the details of the initial routine shown in the step S5 will be described.

On condition that any of key inputting processings is performed (S101; YES), the auto clear timer is started (S103) to set a "predetermined initial state (S111 or S113) at the end of the timer (S105; YES). The same is performed in case the all clear key 95 is pushed (S107; YES). The auto clear timer is started every time a copying operation finishes (S247: see routine of a copying operation).

In the foregoing description, "predetermined initial state" is a state defined by the data registered on the card (S113) in case the IC card is attached (S109; YES) and on the other hand, it is the "basic initial state" (S111) similarly to the step S1 (FIG. 4) in case the IC card is not attached (S109; NO).

(2) Routine of the copying operation

Figure 6A:
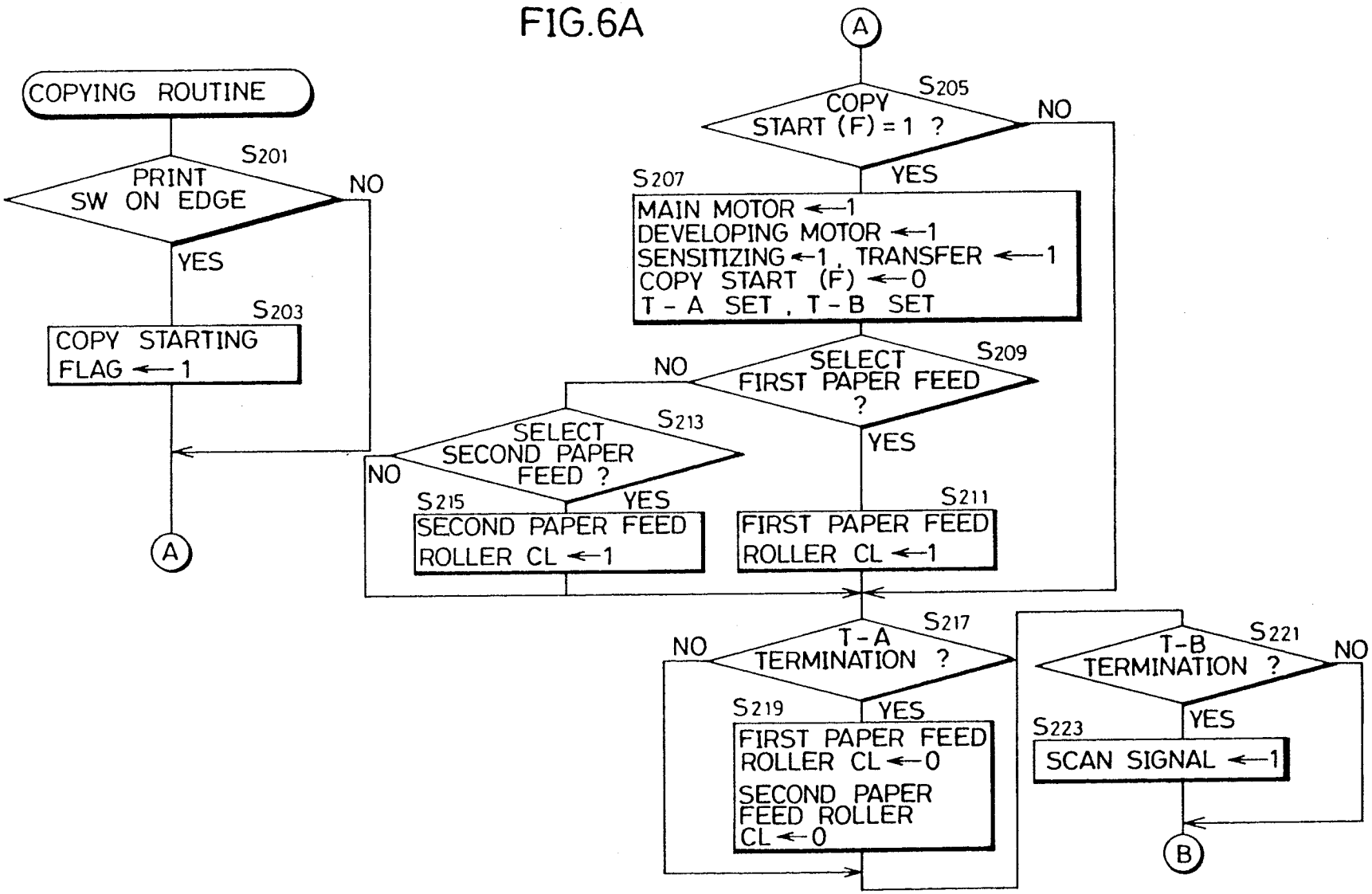
FIGS. 6A and 6B are flow charts showing in detail the copying routine shown in FIG. 4.
Figure 6B:
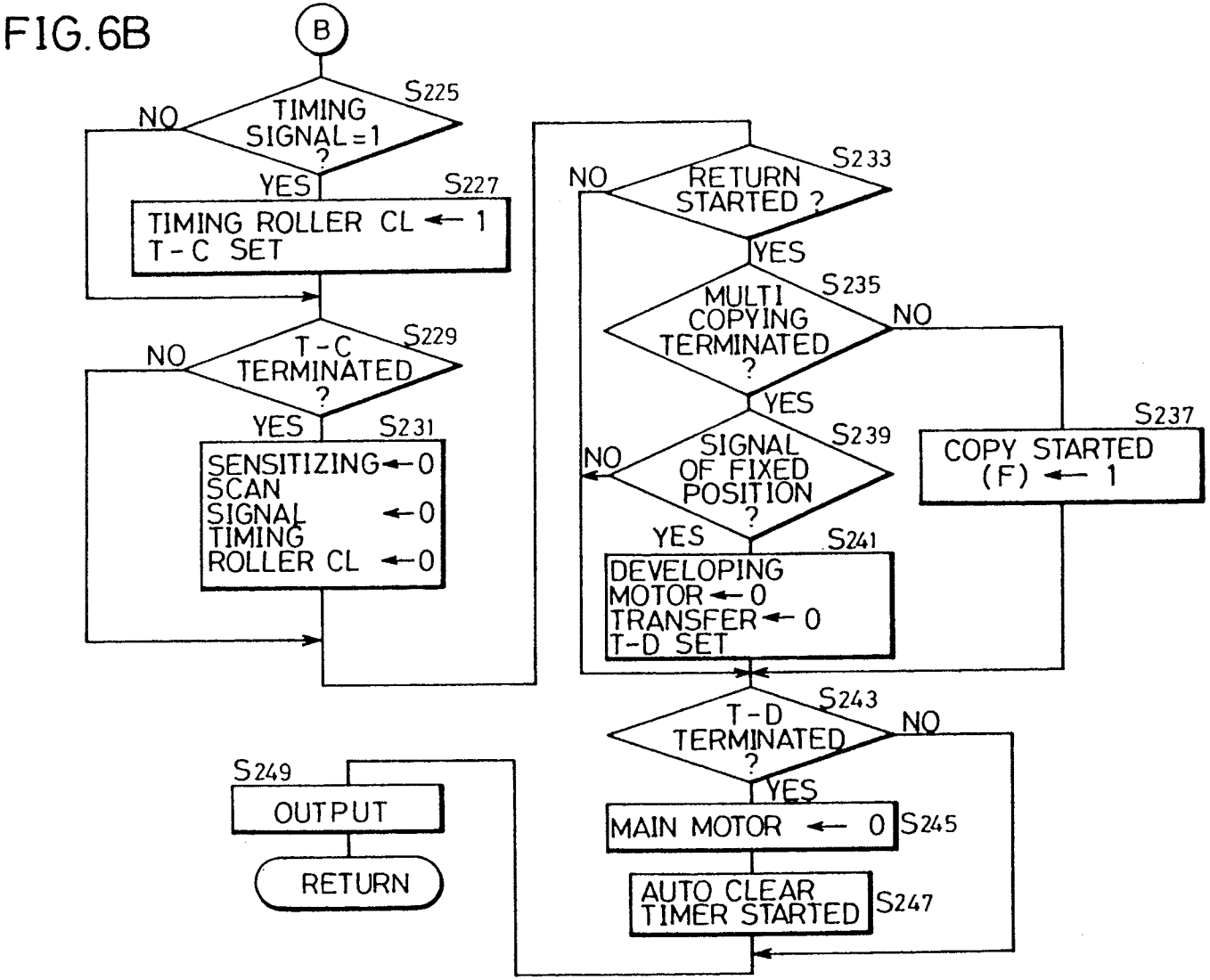

Referring to FIGS. 6A and 6B, the flow chart showing the details of the copying operation routine shown in the step S7 will be described.

In the following paragraphs, the term "on edge" is defined as change in state where a switch, a sensor, a signal or the like changes from the off state to the on status.

S201–S203 are steps for processing the start of control of the copying operation. Namely, a copy starting flag is set (S203) in response to an on-edge of the print switch 71 (S201).

S205–S219 are processings at the beginning of the copying operation.

Namely, when the copy starting flag is set (S205; YES), the main motor, the developing motor, the sensitizing charger and the transfer charger are turned on. Then, the copy starting flag is pulled down to start the timer A and the timer B (S207).

Then, by turning on a paper feed roller clutch of a paper feed inlet corresponding to a selected size of the paper (S209–S215), paper feeding from the cassette is started and thereafter the paper feed roller clutch is turned off (S219) on condition of the termination of the timer A (S217; YES).

S221–S231 are steps for processing various timing controls in scanning.

Namely, on condition that the timer B is over (S221), a scanning signal to the optical system control portion 202 is generated (S223). As a result, exposure scanning is started in the optical system.

Then, when a timing signal from the optical system is inputted (S225; YES), the clutch of the timing roller 73 is turned on to start feeding the paper to the transfer portion and the timer C is started (S227).

Furthermore, on the condition of the termination of the timer C (S229; YES), the sensitizing charger, the scanning signal and the timing roller clutch are turned off (S231).

In the S233–S247, processing for terminating the copying operation is performed.

Namely, in response to the start of the return of the optical system scanner (S233; YES), it is determined whether all the multicopying is terminated or not (S235). In this step, it is also determined whether interruption of copying in the step S349 (will be described later) is caused or not.

When it is determined that the multicopying is terminated or the interruption of copying is caused in the step S349 (S235; YES), upon the input of a signal of a fixed position from the optical system control portion 202 (S239), the developing motor and the transfer charger are turned off and the timer D is started (S241).

On the other hand, in case, the multicopying is not terminated yet in S235 and there is no interruption of copying in the step S349, the copy starting flag is set (S237) to prepare for a subsequent copying operation with respect to the same original.

Thereafter, on the condition of the termination of the timer D (S243; YES), the main motor is turned off (S245) and the auto clear timer is started (S247). The auto clear timer is used in relation with the condition of the initialization, as described above. S249 is a step for outputting the above described processing signal.

(3) IC card detaching routine

Figure 7A:
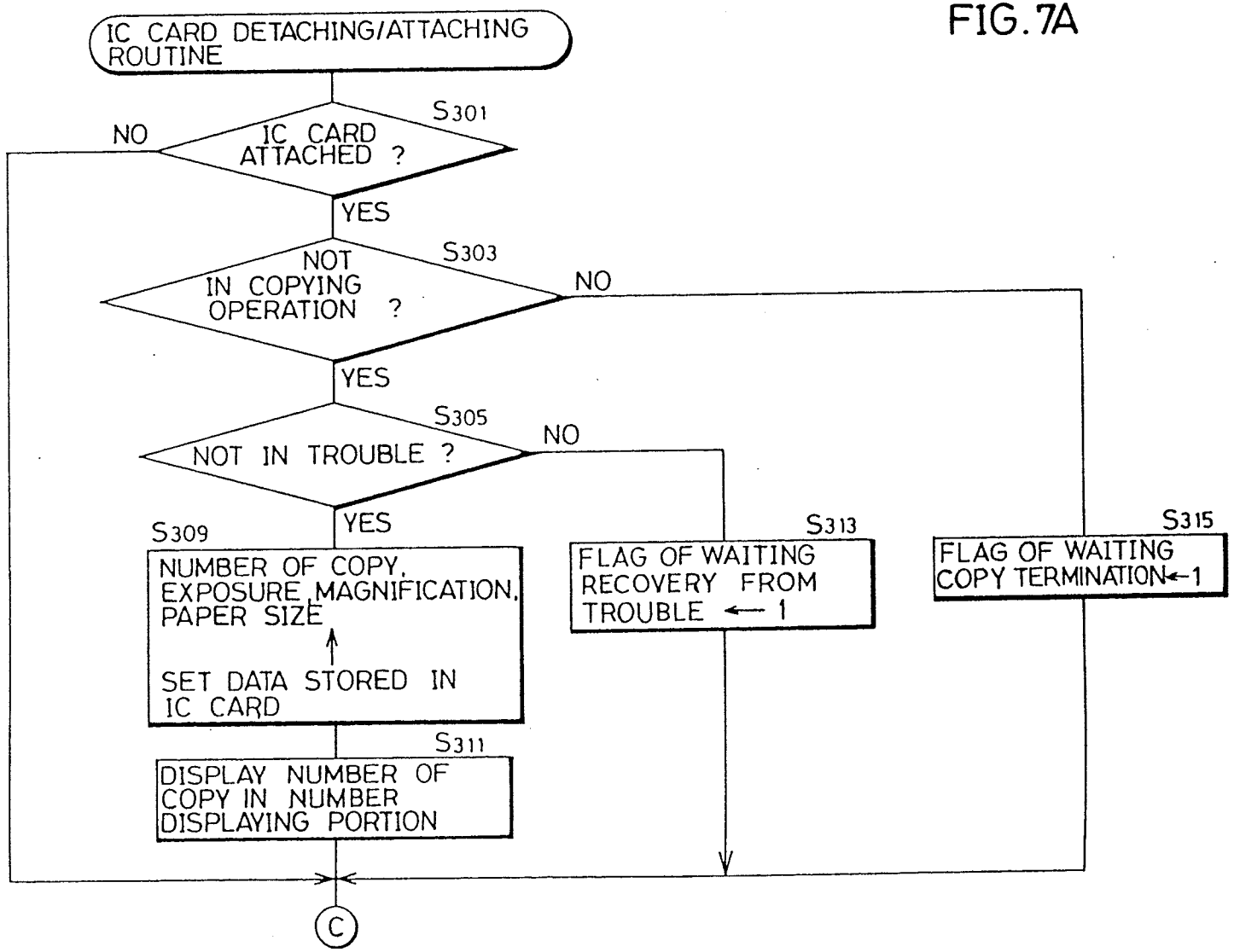
FIGS. 7A, 7B and 7C are flow charts showing in detail an IC card detaching routine shown in FIG. 4.
Figure 7B:
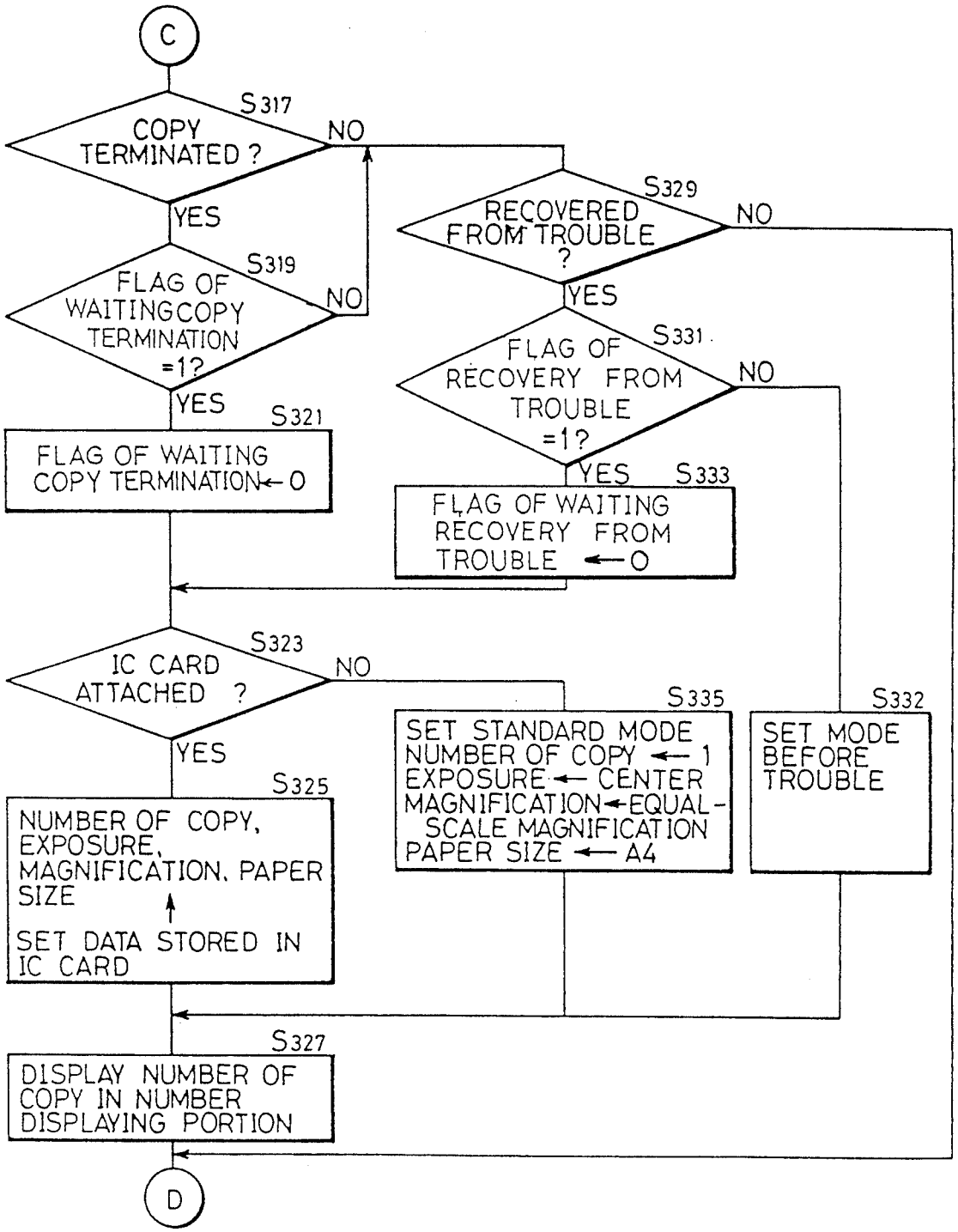
Figure 7C:
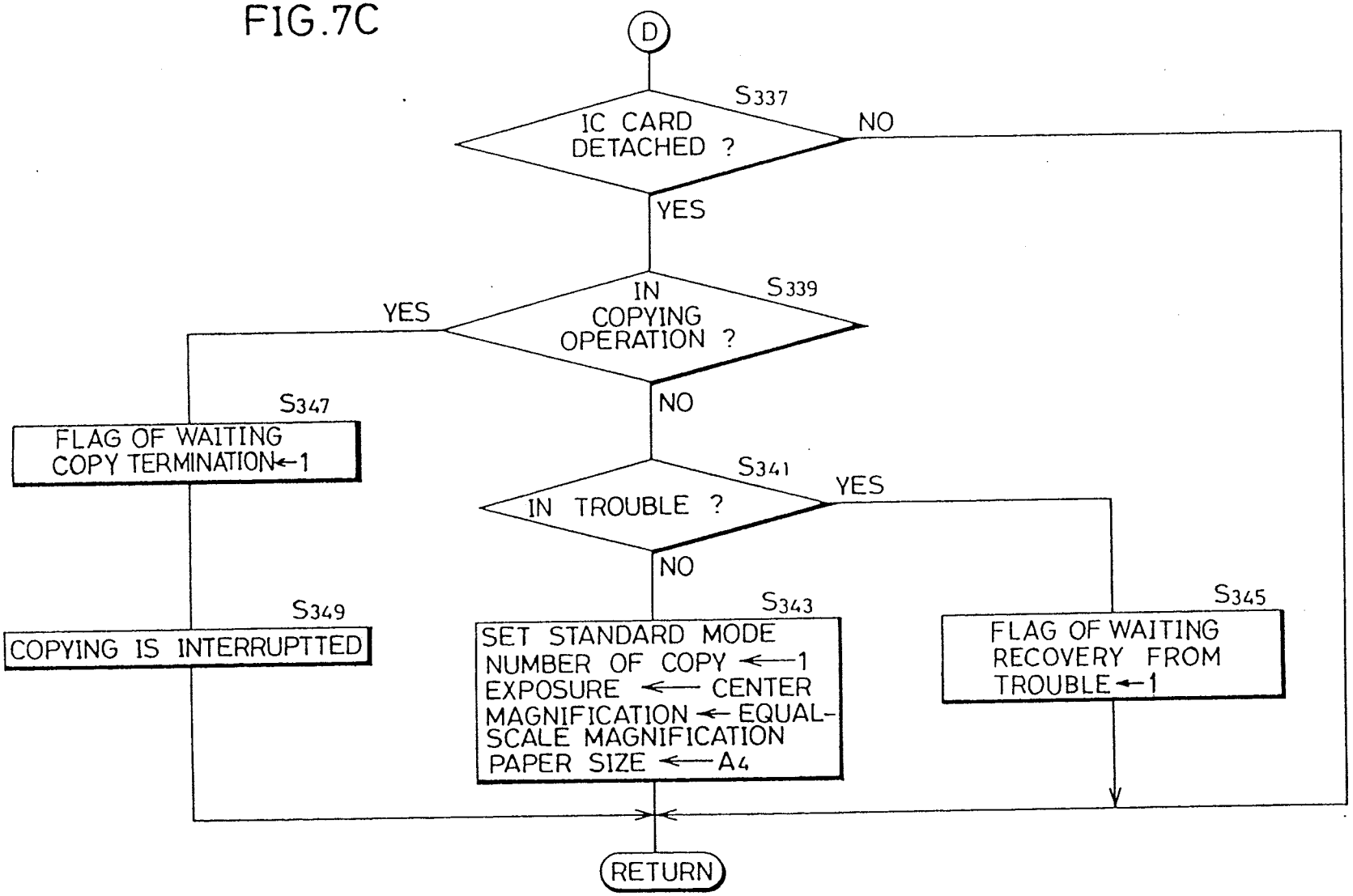

With reference to FIGS. 7A–7C, details of the IC card detaching routine shown in S9 will be described.

In S301–S315, processing at the time of inserting the IC card is performed. More specifically, when the IC card 200 is attached to the card insertion portion 70 (S301; YES), the mode registered on the IC card 200 is attached in the copying apparatus (S309). The number displaying portion 72 displays the set number of copy (S311), on condition that it is neither in the copying operation (S303: YES) nor in the trouble such as a paper jam (S305; YES) when the IC card 200 is attached.

On the other hand, in case the copying apparatus is in operation at the time of attaching of the IC card 200 (S303; NO), the flag of waiting copy termination is set (S315). If it is in trouble such as a paper jam (S305; NO), the flag of waiting the recovery from the trouble is set (S313).

In the steps S317-S335, performed are processings which are executed at the termination of the copying operation or at the time of recovery from the trouble.

More specifically, if, at the termination of copying operation (S317; YES), the flag of waiting copy termination is set (S319; YES), the flag of waiting copy termination is reset (S321). In case the flag of waiting recovery from the trouble is set (S331; YES) during the recovery from the trouble (S329; NO), the flag of waiting recovery from the trouble is reset (S333).

When the flag of waiting copy termination is reset and the flag of waiting recovery from the trouble is set, which means that the IC card 200 is inserted during the trouble, in case the IC card 200 is attached (S323; YES), the mode registered on the IC card 200 is set in the copying apparatus (S325). In addition, in case the IC card 200 is not attached (S323; NO), the standard mode (basic initial state) is set in the copying apparatus (S335). If the flag of waiting recovery from the trouble is reset in S331, which means that the IC card 200 is not inserted during the trouble, the copying apparatus is set in the mode which is before the trouble (S332).

Thereafter, the displaying portion 72 displays the set number of copy.

The steps S337–S349 represent processings performed when the IC card 200 is detached from the card insertion portion.

More specifically, if the copying apparatus is in the copying operation (S339; YES) at the time of detaching of the IC card 200 (S337; YES), the flag of waiting copy termination is set (S347), and even if it is in the execution of copying of a lot of paper, the copying operation is interrupted when the operation being executed now is finished (S349). As a result, the determination in the above described step S235 (FIG. 6B) becomes YES even before the termination of copying a lot of paper.

On the other hand, in case it is in trouble such as a paper jam at the time of detaching of the IC card 200 (S341; YES), the flag of waiting recovery from the trouble is set (S345).

If, at the time of detaching of the IC card 200 (S337; YES), it is neither in the execution of copying (S339; NO) nor in trouble (S341; NO), the standard mode (basic initial state) is set in the copying apparatus (S343).

The mode setting processing and the flag setting/resetting processing are performed as described in the foregoing, when the IC card 200 is attached or detached during the copying operation or the recovery from the trouble.

(4) Trouble routine

Figure 8:
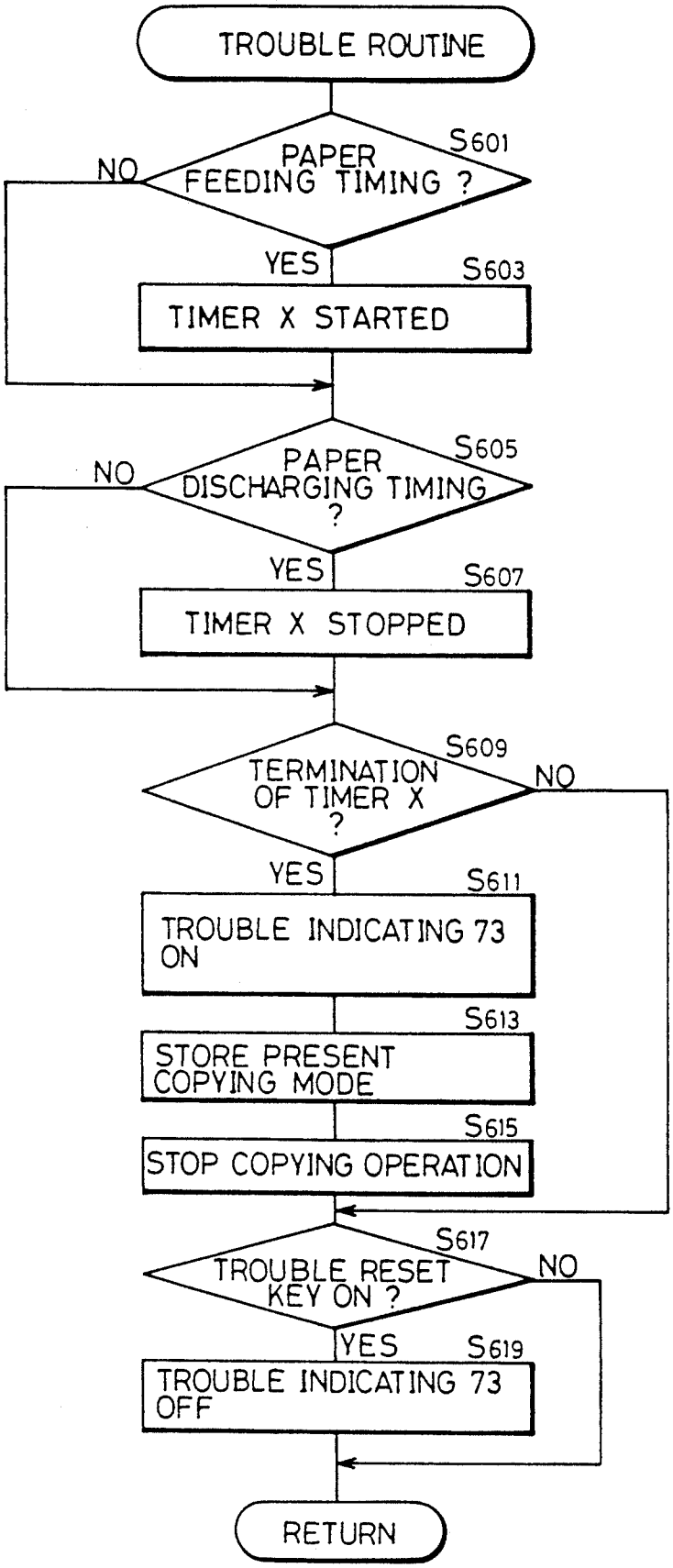
FIG. 8 is a flow chart showing in detail a trouble routine shown in FIG. 4.

With reference to FIG. 8, details of the trouble routine shown in the above described step S15 will be described.

S601–S611 are steps for detecting paper feed jam.

First, in synchronization with the paper feeding timing (S601), a timer X is started (S603), and in synchronization with the paper discharging timing (S605) the timer X is stopped (S607). The value of the timer X is set to have enough time period from the feeding to the discharging of the paper. Accordingly, the termination of the timer X (S609; YES) signifies generation of the paper feed jam.

In case of the generation of the paper feed jam, the trouble indicating LED 73 is lighted (S611), the present copying mode is saved in the memory (S613), the copying operation is stopped (S615) to wait for the trouble reset key 65 to be turned on after recovering from the trouble (S617). Then, the trouble indication is turned off (S619). The copying apparatus is controlled as described in the foregoing.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A copying apparatus comprising:

a main body having image forming means operable in various modes, storage medium which can be attachable to and detachable from said main body for storing information for setting an operation mode of said image forming means, first controlling means for reading the information stored in said storage medium when said storage medium is attached to said main body when said image forming means is not operating, and setting the operation mode of said image forming means, based on said read out information, second controlling means for setting the operation mode of said image forming means by the information stored in said storage medium after the termination of the operation of said image forming means, when said storage medium is attached to said main body during the operation of said image forming means.

2. A copying apparatus according to claim 1, wherein said second controlling means sets a predetermined standard operation mode after the termination of the operation of said image forming means, when said storage medium is set in said main body during the operation of said image forming means, and said storage medium is detached from said main body before the termination of said image forming operation.

3. A copying apparatus according to claim 1, wherein said storage medium is an IC card.

4. A copying apparatus comprising:

a main body having image forming means, storage medium which can be attachable to and detachable from said main body for storing information for controlling said image forming means, first controlling means for reading the information stored in said storage medium when said storage medium is attached to said main body when said image forming means is not being operated, and controlling said image forming means, based on said read out information, second controlling means for controlling said image forming means by the information stored in said storage medium after the termination of the operation of said image forming means, when said storage medium is set in said main body during the operation of said image forming means.

5. A copying apparatus according to claim 4, wherein said storage medium is an IC card.

6. A copying apparatus comprising:

a main body having image forming means operable in various modes, storage medium which can be attachable to and detachable from said main body for storing information for setting an operation mode of said image forming means, reading means for reading the information from said storage medium which is attached to said main body, first controlling means for setting an operation mode of said image forming means, based on said read out information, second controlling means for prohibiting an operation of said reading means during the operation of said image forming means.

7. A copying apparatus comprising:

a main body having image forming means, storage medium which can be attachable to and detachable from said main body for storing information for controlling said image forming means, reading means for reading the information from said storage medium attached to said main body, first controlling means for controlling said image forming means, based on said read out information, second controlling means for prohibiting the operation of said reading means during the operation of said image forming means.

8. A copying apparatus according to claim 7, wherein said reading means starts an operation of said reading means in response to said storage medium being attached to the main body when said image forming means does not operate.

9. A copying apparatus according to claim 7, wherein said second controlling means permits an operation of said reading means after the termination of the operation of the image forming means.

10. A copying apparatus comprising:

a main body having images forming means operable in various modes, storage medium which can be attachable and detachable from said main body for storing information for setting an operation modes of said image forming means, controlling means for reading the information stored in said storage medium attached to said main body and setting an operation mode of said image forming means, based on said read out information, stopping means for stopping the operation of said image forming means and setting a predetermined standard operation mode, when said storage medium is detached from said main body during the operation of said image forming means.

11. A copying apparatus according to claim 10, wherein said storage medium is a IC card.

12. A copying apparatus comprising:

a main body having image forming means, storage medium which can be attachable to and detachable from said main body for storing information for controlling said image forming means, controlling means for reading the information stored in said storage medium attached to said main body and controlling said image forming means, based on said read out information, stopping means for stopping the operation of said image forming means when said storage medium is detached from said main body during the operation of said image forming means.

13. A copying apparatus according to claim 12, wherein said controlling means controls said image forming means in accordance with predetermined information, after the operation of said image forming means is stopped.

14. A copying apparatus according to claim 12, wherein said storage medium is an IC card.

15. A copying apparatus comprising:

a main body having image forming means operable in various modes, trouble detecting means for stopping the operation of said image forming means when trouble of said image forming means occurs, storage medium which can be attachable to and detachable from said main body and stores information for setting an operation mode of said image forming means, first controlling means for reading the information stored in said storage medium attached to said main body and for setting the operation mode of said image forming means, based on said read out information, second controlling means for automatically setting the operation mode before the trouble, after the termination of processing for the trouble, third controlling means for prohibiting an operation of said second controlling means to set an operation mode of said image forming means by the information stored in said storage medium after the termination of the processing for said trouble, when said storage medium is attached to said main body at the time of the trouble.

16. A copying apparatus according to claim 15, wherein said third controlling means prohibits the operation of said second controlling means and setting a predetermined standard operation mode after the termination of the processing for said trouble, when said storage medium is set in said main body at the time of the trouble and said storage medium is detached from said main body before the termination of said trouble processing.

17. A copying apparatus according to claim 15, wherein said storage medium is an IC card.

18. A copying apparatus comprising:

a main body having image forming means operable in various modes, trouble detecting means for stopping an operation of said image forming means when trouble of said image forming means occurs, storage medium which can be attachable to and detachable from said main body for storing information for setting an operation mode of said image forming means, first controlling means for reading the information stored in said storage medium attached to said main body and setting an operation mode of said image forming means, based on said read out information, second controlling means for automatically setting an operation mode before the trouble, after the termination of said trouble processing, third controlling means for prohibiting the operation of said second controlling means and setting a predetermined standard operation mode after the termination of said trouble processing, when said storage medium is detached from said main body during said trouble.

19. A copying apparatus according to claim 18, wherein said storage medium is an IC card.

* * * * *

UNITED STATES PATENT AND TRADEMARK OFFICE

CERTIFICATE OF CORRECTION

PATENT NO. : 5,041,873

DATED : August 20, 1991

INVENTOR(S) : Yoichi Kawabuchi, et al.

It is certified that error appears in the above-identified patent and that said Letters Patent is hereby corrected as shown below:

In col. 1, line 35, change "to" (third occurrence) to --be--.

In col. 2, line 27, before "IC", insert --the--.

In col. 10, line 56 (Claim 10, line 2), change "images" to --image--.

In col. 10, line 60 (Claim 10, line 6), change "modes" to --mode--.

Signed and Sealed this

Ninth Day of March, 1993

*Attest:*

STEPHEN G. KUNIN

*Attesting Officer*

*Acting Commissioner of Patents and Trademarks*